US007384246B2

(12) United States Patent
Diaferia et al.

(10) Patent No.: US 7,384,246 B2
(45) Date of Patent: Jun. 10, 2008

(54) PUMP ELEMENT AND PISTON PUMP FOR GENERATING HIGH FUEL PRESSURE

(75) Inventors: Antonio Diaferia, Corato (IT); Giuseppe Putignano, Noci (IT); Stefano Polito, Bari (IT); Sandra Ranaldo, Bologna (IT)

(73) Assignee: Robert Bosch GmbH, Stuttgart (DE)

( * ) Notice: Subject to any disclaimer, the term of this patent is extended or adjusted under 35 U.S.C. 154(b) by 236 days.

(21) Appl. No.: 10/450,175

(22) PCT Filed: Jul. 27, 2002

(86) PCT No.: PCT/DE02/02780

§ 371 (c)(1),
(2), (4) Date: Nov. 19, 2003

(87) PCT Pub. No.: WO03/042534

PCT Pub. Date: May 22, 2003

(65) Prior Publication Data

US 2004/0089146 A1 May 13, 2004

(30) Foreign Application Priority Data

Oct. 15, 2001 (DE) ..... 101 50 351

(51) Int. Cl.
*F04B 1/04* (2006.01)
*F01B 1/00* (2006.01)

(52) U.S. Cl. ..... 417/273; 92/72

(58) Field of Classification Search ..... 417/273, 417/470; 92/72, 128, 129
See application file for complete search history.

(56) References Cited

U.S. PATENT DOCUMENTS

| | | | | |
|---|---|---|---|---|
| 2,302,865 | A | 11/1942 | Wilcox | |
| 4,690,620 | A * | 9/1987 | Eickmann | 417/273 |
| 5,131,818 | A * | 7/1992 | Wittkop et al. | 417/273 |
| 5,571,243 | A * | 11/1996 | Arnold et al. | 123/198 DB |
| 5,979,297 | A * | 11/1999 | Ricco | 92/129 |
| 6,176,223 | B1 * | 1/2001 | Kuhn et al. | 123/495 |
| 6,244,832 | B1 * | 6/2001 | Guentert et al. | 417/269 |
| 6,347,574 | B1 * | 2/2002 | Guentert et al. | 92/72 |
| 6,350,107 | B1 * | 2/2002 | Hamutcu | 417/273 |
| 6,431,842 | B1 * | 8/2002 | Furuta | 417/273 |
| 6,514,050 | B1 * | 2/2003 | Streicher | 417/273 |

FOREIGN PATENT DOCUMENTS

| | | |
|---|---|---|
| DE | 198 02 475 A1 | 7/1999 |
| DE | 198 36 901 A1 | 2/2000 |
| DE | 198 47 044 A1 | 4/2000 |

* cited by examiner

*Primary Examiner*—Devon Kramer
*Assistant Examiner*—Vikansha Dwivedi
(74) *Attorney, Agent, or Firm*—Ronald E. Greigg

(57) ABSTRACT

A pump element and a piston pump for generating high fuel pressure are proposed, in which tilting of the piston base relative to a drive shaft is effectively suppressed, so that the service life of the high-pressure fuel pump is increased.

34 Claims, 3 Drawing Sheets

Fig. 4
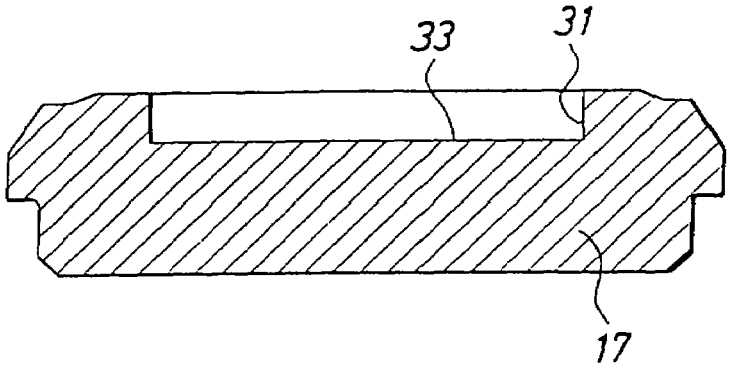
Fig. 5
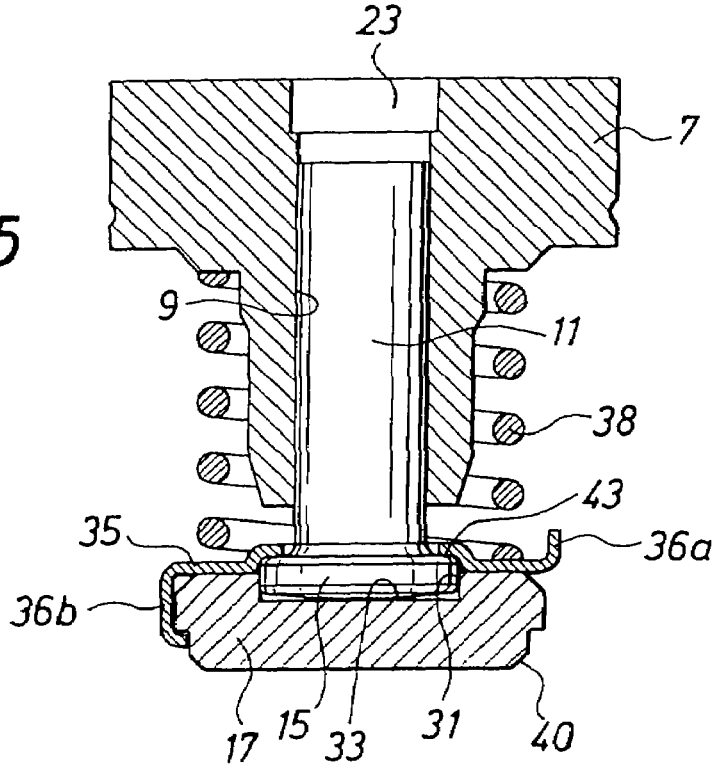
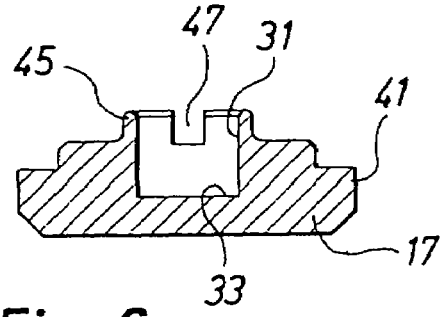
Fig. 6
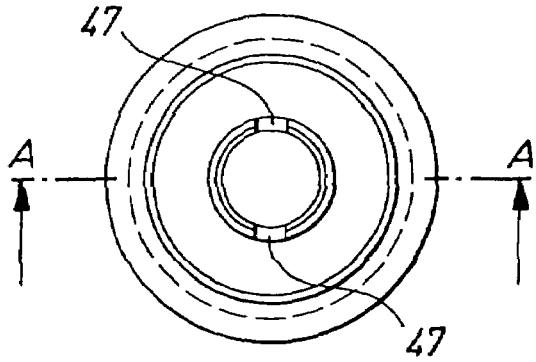
Fig. 7

PUMP ELEMENT AND PISTON PUMP FOR GENERATING HIGH FUEL PRESSURE

CROSS-REFERENCE TO RELATED APPLICATIONS

This application is a 35 U.S.C. 371 application of PCT/DE02/02780 filed on Jul. 27, 2002.

BACKGROUND OF THE INVENTION

1. Field of the Invention

The invention relates to an improved pump element for a piston pump for generating high fuel pressure in fuel injection systems of internal combustion engines and to an improved piston pump employing the pump element.

2. Description of the Prior Art

In nearly all types of piston pumps, the rotary motion of a drive shaft is converted into an oscillating motion of the piston of a pump element. In so-called internally braced radial piston pumps for generating high fuel pressure in fuel injection systems of internal combustion engines, a plurality of pump elements are disposed, for instance radially to a drive shaft supported in a pump housing. The pistons of the pump elements are actuated by an eccentric portion of the drive shaft or by cams of the drive shaft. Because of the high pressures to which the fuel must be brought, the forces to be transmitted by the drive shaft to the pistons are very high. When the rotary motion of the drive shaft is converted into the oscillating motion of the pistons of the pump elements, forces between the drive shaft and the pistons occur that also act in the circumferential direction of the drive shaft. Similar effects also occur between the drive shaft and the pistons of in-line injection pumps or distributor injection pumps.

To reduce the wear between the pistons and the drive shaft, it is known from German Published, Nonexamined Patent Disclosure DE-OS 198 02 475 to provide a ring with flat faces, which does not rotate with the drive shaft, on the eccentric portion of the drive shaft of a radial piston pump. On the end of the piston toward the ring, a plate is provided in this radial piston pump. This plate is braced against the flat faces on the ring. When the pump elements are only partly filled in partial-load operation, the ring tends to rotate relative to the pump elements, because of the uneven load. The result is excessive loads on both the ring and the pump elements. These loads can lead to failure of a pump element or of the entire high-pressure fuel pump.

OBJECTS AND SUMMARY OF THE INVENTION

The object of the invention is to furnish a pump element and a piston pump for generating high fuel pressure which is simple in construction and has still further-enhanced reliability under all operating conditions.

In a pump element for a piston pump for generating high fuel pressure in fuel injection systems of internal combustion engines, with at least one piston, disposed in a cylinder bore, the piston having a piston base and a piston shaft, and with a plate, mounted on the piston base, for transmitting the pumping motion from a drive mechanism to the piston, the piston base having a bearing face cooperating with an indentation in the plate, this object is attained according to the invention in that the bearing face and the indentation form an essentially plane contact zone.

Because of the plane contact zone between the bearing face and the indentation, it is possible for the forces to be transmitted in the axial direction of the piston to be transmitted uniformly over a large area. Also because of the plane end of the piston shaft, it can be prevented that the plate will execute a tilting motion, which is caused or made possible by the reciprocating motions in the tangential direction of the ring supported on the drive shaft. It is attained as a result that under all operating states of the high-pressure fuel pump, the ring will execute no rotary motion at all, or only a very slight rotary motion, and thus the bending stress on the plate and the piston is reduced. This is significant above all when the pump elements are not pumping the full pumping quantity but instead are only partly filled because of corresponding throttling of the fuel inflow. When the pump elements are partly filled, vapor bubble formation occurs in the pump elements, resulting in a nonuniform transmission of torque from the drive shaft to the pump elements. As a consequence, the ring tends to execute the aforementioned unwanted rotary motions. The embodiment of the pump elements according to the invention suppresses the rotary motions of the ring to such an extent that point-type excessive stresses on the pump element or the ring no longer occur. As a result, the service life of the pump elements and of the overall piston pump is increased without an increase in production costs.

It is especially advantageous if the contact zone is larger than or equal to the cross-sectional area of the piston shaft, so that the unwanted tilting of the plate and the unwanted rotary motion of the ring are reduced further.

To enable compensating for slight imprecisions in production or skewed positions of the longitudinal axis of the pistons relative to the longitudinal axis of the drive shaft, it can furthermore be provided that the bearing face or the face of the indentation that together with the bearing face forms the contact zone is curved, with a radius greater than 20× the diameter of the piston shaft. With this large radius of curvature, it is assured that production variations can be compensated for, without enabling tilting of the plates or a rotary motion of the ring.

In a further feature of the invention, it is provided that the piston base and the plate are joined together by positive engagement by means of a plate holder, which prevents damage to these components and makes it easier to form a load-bearing film of lubricant.

In a further advantageous feature of the invention, the piston base has a collar, and the plate holder is joined to the piston via the collar, so that on the one hand, a large contact zone between the plate and the piston base becomes possible, and on the other, a more-secure positive engagement between the piston and the plate holder is assured. This version is also easy to assemble, since the number of components is very low.

Alternatively, the piston base can also have a groove with a snap ring, and the plate holder is braced on the snap ring, so that the production of the piston is simplified still further.

In further features of the invention, it can be provided that the plate holder is joined to the plate by creative forming, in particular by crimping or folding, so that a durably loadable connection of the plate holder and the plate is established in a simple and effective way.

To make assembly easier, the plate, on its circumference on the side toward the piston, can have a chamfer.

An especially secure connection between the plate holder and the plate can be attained if the plate has a collar, and that the plate holder surrounds the collar.

Alternatively, the plate can also be joined directly to the piston, in particular by crimping or folding. In this variant embodiment, the number of components is reduced still further, which has a positive effect on the production costs.

It has also proved to be advantageous if a crimped edge is embodied on the plate, and the crimped edge engages the groove of the piston or surrounds the collar of the piston, since in these exemplary embodiments the aforementioned advantages also come into play.

BRIEF DESCRIPTION OF THE DRAWINGS

Further advantages and advantageous features of the invention can be learned from the detailed description contained herein below, taken in conjunction with the drawings, in which:

FIGS. 3-5, a second exemplary embodiment of a pump element of the invention; and FIGS. 6-7, a cross section and a plan view on a third exemplary embodiment of a plate of the invention.

DESCRIPTION OF THE PREFERRED EMBODIMENTS

Figure 1:
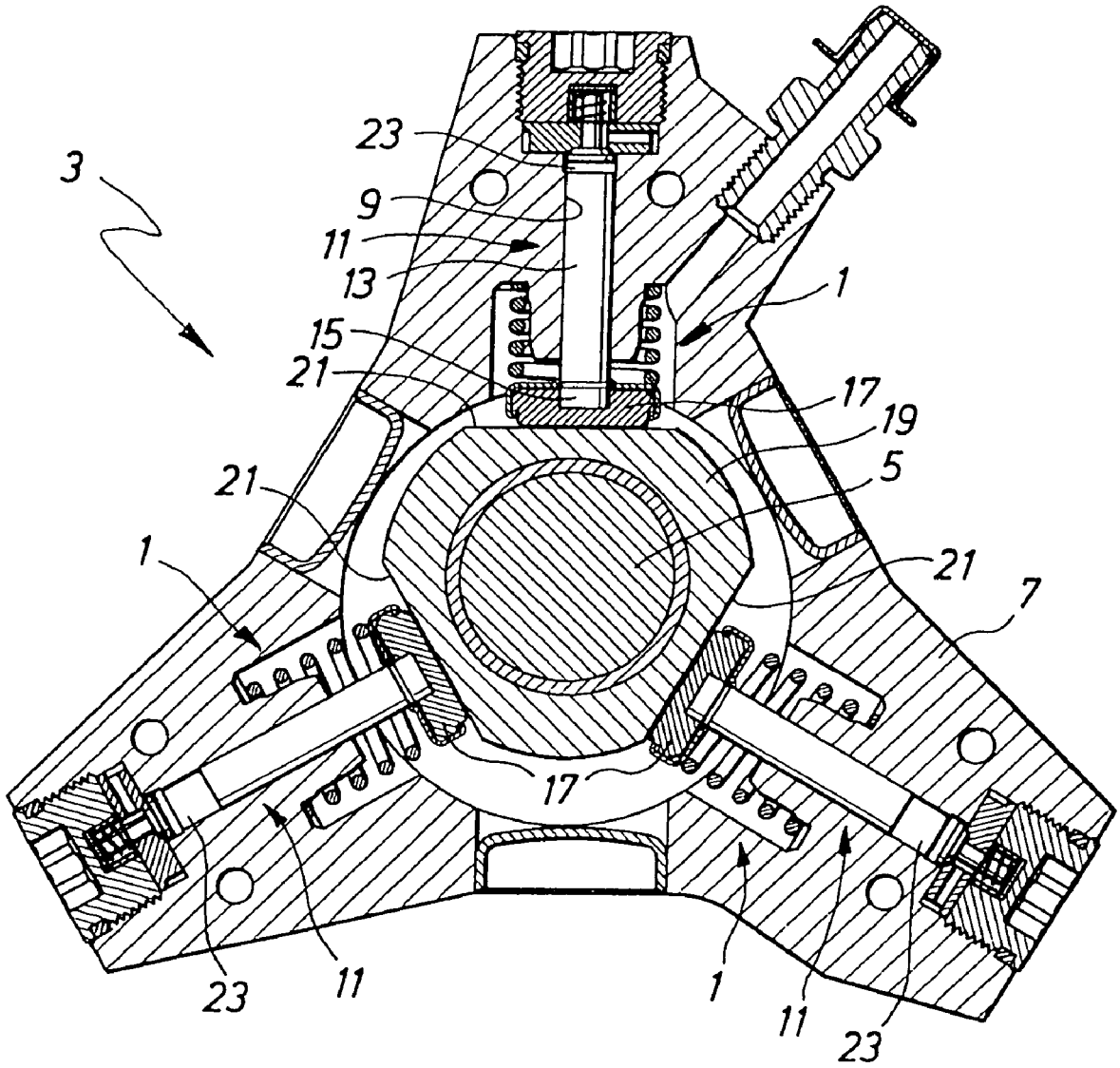
FIG. 1 is a cross section through one exemplary embodiment, embodied as a radial piston pump, of a high-pressure fuel pump of the invention.

In FIG. 1, a section is shown through a radial piston pump, equipped with pump elements 1 of the invention, for generating high fuel pressure in injection systems of internal combustion engines.

In this radial piston pump, identified overall by reference numeral 3, there are three pump elements 1, disposed at an angle of 120° each from one another, about a drive shaft 5. In the sectional plane of FIG. 1, an eccentric portion of the drive shaft 5 is shown. Above and below the plane of the drawing, the drive shaft 5 is rotatably supported (not shown) in a housing 7 of the radial piston pump 3.

A pump element 1 comprises a cylinder bore 9 and a piston 11, which is guided sealingly in the cylinder bore 9. The piston 11 in turn comprises a piston shaft 13 and a piston base 15. A plate 17 is secured to the piston base 15.

A ring 19 with flat faces 21 is disposed between the eccentric portion of the drive shaft 5 shown in FIG. 1 and the plate 17. This polygonal ring 19 serves to convert the rotary motion of the eccentric portion of the drive shaft 5 into an oscillating motion. During a rotation of the eccentric portion of the drive shaft 5, the polygonal ring 19 oscillates, both in the direction of the longitudinal axis of the pistons 11 and perpendicular to the longitudinal axis of the pistons 11. The polygonal ring 19 should not rotate in this process. This creates a sliding motion between the plate 17 and the flat face 21. A tilting moment on the plate 17 results from this sliding motion.

If the pumping chambers 23 of the pump elements, disposed above the pistons 11, are only partly filled with fuel (not shown) in partial-load operation of the radial piston pump 3, the power transmitted from the drive shaft 5 to the pump elements 1 via the ring 19 is not uniform. As a consequence, the polygonal ring 19 tends to rotate somewhat in the direction of rotation of the drive shaft 5. This results in a considerable bending moment on the plates 17. Because of the embodiment according to the invention of the piston base 15 and the plates 17, it is possible to suppress this unwanted rotary motion of the polygonal ring 19 in all operating states, or to reduce it to such an extent that it no longer adversely affects the service life of the radial piston pump 3 or its pump elements 1.

Figure 2:
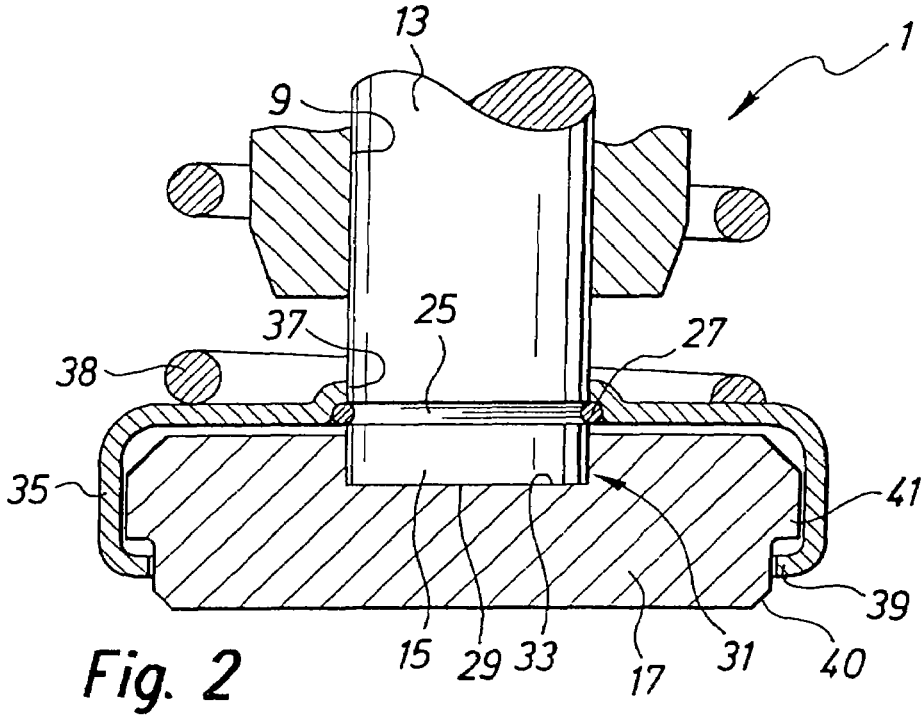
FIG. 2, a more-detailed illustration of the first exemplary embodiment of a pump element of the invention.

In FIG. 2, a detail of a first exemplary embodiment of a pump element 1 of the invention is shown in cross section. In this exemplary embodiment, a groove 25 is formed into the piston base 15, and a snap ring 27 is placed in the groove 25.

The piston base has an essentially plane bearing face 29, which protrudes into an indentation 31 in the plate 17. The bearing face 29 of the piston base 15 rests on the bottom 33 of the indentation 31. The result is an essentially plane contact zone between the bearing face 29 and the indentation 31, that is, the bottom 33 of the indentation 31.

The contact zone (not identified by reference numeral in FIG. 2), in the first exemplary embodiment, is as large as the cross section of the piston shaft 13, so that a very good introduction of the forces in the axial direction of the piston shaft, which are transmitted from the plate 17 to the piston base 15, exists. Moreover, the plane contact zone prevents the plate 17 from being to tilt relative to the piston shaft 13. As a consequence, the above-described rotary motion of the polygonal ring 19 (see FIG. 1) in partial-load operation of the radial piston pump 3 is also effectively suppressed, and a plane contact zone always exists between the piston base 15 and the plate 17 on the one hand, and between the plate 17 and the flat faces 21 of the polygonal ring 19, on the other. Hence point-type excessive stress on the flat faces 21, the plate 17, or the piston base 15 does not occur. The result is an increased service life of the radial piston pump 3.

In order that the piston shaft 13, after reaching its top dead center (not shown) will be moved back to bottom dead center (not shown), a plate holder 35 is provided, which in an opening 37 receives the piston shaft 13. By means of the snap ring 27, a force from the plate holder 35 in the direction of the piston base 15 can be transmitted to the piston shaft 13. A compression spring 39, which is braced on one end on the plate holder 35 and on the other on the housing 7 of the radial piston pump 3 (see FIG. 1), presses the plate holder 35 from top dead center to bottom dead center when the eccentric portion of the drive shaft 5 (see FIG. 1) executes the corresponding rotary motion. Via the snap ring 27, this motion is also transmitted to the piston shaft 13. So that the plate 17 will not be able to come loose from the piston base 15, the plate holder 35 also has a crimped edge 39, which surrounds a collar 41 of the plate 17. The exemplary embodiment shown in FIG. 2 is very simple to produce, since the piston shaft 13 and the piston base 15 have the same diameter and can thus be ground in the same chuck. To enable compensating for slight errors of alignment between the cylinder bore 9 and the pivot axis of the drive shaft 5 (not shown), it can be provided that either the bearing face 29 or the bottom 33 of the indentation 31 is slightly curved. It has proved to be advantageous if the radius of curvature is greater than 20× the diameter of the piston shaft 13. In that case, a plane contact zone between the bearing face 29 and the bottom 33 is still achieved, yet point-type excessive stresses do not occur.

On the bearing face 29, which comes into contact with the ring 19, the plate 17 has a chamfer 40. The effect of the chamfer 40 is that even if rotation of the polygonal ring 19, not shown, should occur under unfavorable conditions, the plate holder 35 will not be damaged by the resultant tilting motion of the plate 17. The chamfer 40 can be provided in all the exemplary embodiments of the pump element 1 of the invention.

Figure 3:
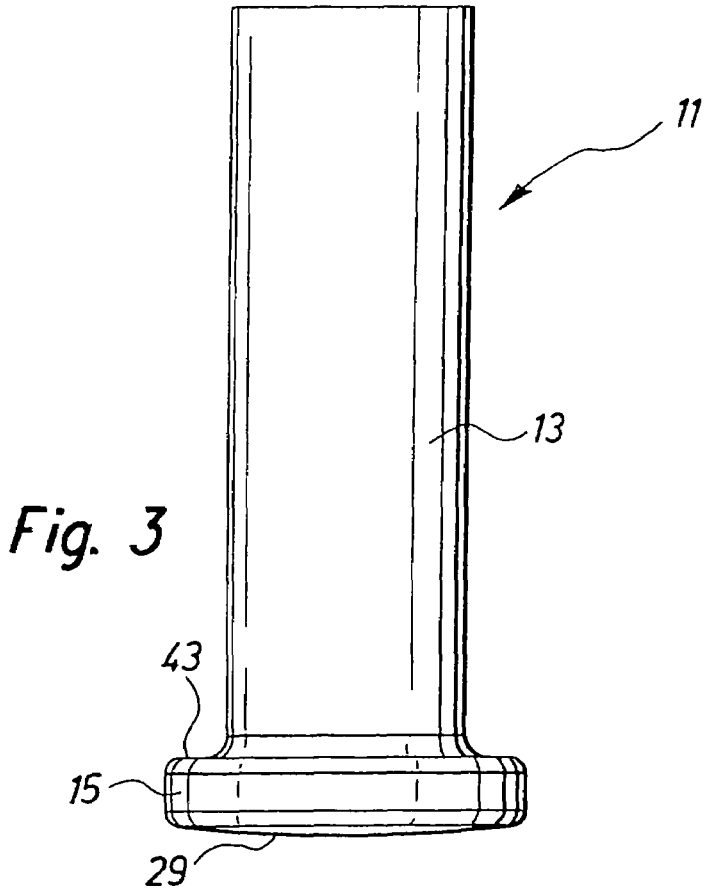

In FIG. 3, a piston 11 of a second exemplary embodiment of a pump element of the invention is shown. In this exemplary embodiment, the piston base 15 adjoining the piston shaft 13 has a markedly larger diameter than the piston shaft 13. It is attained as a result that the piston base 15 has a collar 43. Because of the collar 43, the bearing face 29 of the piston base 15 is enlarged. In this exemplary embodiment, the bearing face 29 is embodied as slightly curved.

In FIG. 4, a plate 17 that belongs to the piston 11 of FIG. 3 is shown. The indentation 31 is dimensioned such that the piston base 15 fits precisely into the indentation 31.

In FIG. 5, the piston 11 and the plate 17 of FIGS. 3 and 4 are shown in the assembled state. In this exemplary embodiment, the plate holder 35 transmits the force, exerted on it by the spring 38, onto the piston shaft 13 via the collar 43. As a result, the groove 25 and the snap ring 27 (see FIG. 2) can be omitted. It is immediately clear from FIG. 5 that the contact zone between the piston base 15 and the plate 17 is larger than in the first exemplary embodiment. As a consequence, the load per unit of surface area between the piston base 15 and the bottom 33 of the indentation 31 in the plate 17 is reduced further. Moreover, the rotation of the polygonal ring 19 (see FIG. 1) can be suppressed even more effectively.

For centering the spring 38, the plate holder 35 has first lugs 36*a*, which are curved upward. In alternation with the first lugs 36*a*, the plate holder 35 has second lugs 36*b*, which are curved downward. The plate 17 is fixed to the piston base 15 by the second lugs 36*b*.

On the bearing face 29, which comes into contact with the ring 19, the plate 17 has a chamfer 40. The effect of the chamfer 40 is that even if rotation of the polygonal ring 19, not shown, should occur under unfavorable conditions, the plate holder 35 will not be damaged by the resultant tilting motion of the plate 17. The chamfer 40 can be provided in all the exemplary embodiments of the pump element 1 of the invention.

In FIGS. 6 and 7, a plate 17 of a third exemplary embodiment of a pump element of the invention is shown in cross section and in plan view. In this exemplary embodiment, no plate holder is provided. The requisite positive-engagement connection between the piston shaft 13 (not shown) and the plate 17 is established via a crimped edge 45. If the piston base 15 of a piston 11, not shown, has been introduced into the indentation 31 of the plate 17, the crimped edge 45 is bent over inward and pressed into a groove in the piston 11, not shown. The groove and the crimped edge 45 must be dimensioned such that in all cases the piston base 15 (not shown) will rest on the bottom 33 of the indentation 31. To make it crimping the crimped edge 45 inward easier, recesses 47 are provided in the crimped edge 45.

The above-described exemplary embodiments of pump elements are not limited to radial piston pumps, but instead can also be used in in-line or distributor injection pumps.

The invention claimed is:

1. In a pump element for a piston pump (3) for generating high fuel pressure in fuel injection systems of internal combustion engines, with at least one piston (11), disposed in a cylinder bore (9), the piston (11) having a piston base (15) and a piston shaft (13), and with a plate (17), mounted on the piston base (15), for transmitting the pumping motion from a drive mechanism (5) to the piston (11), the piston base (15) having a bearing face (29) cooperating with an indentation (31) in the plate (17), the improvement wherein the bearing face (29) protrudes into the indentation (31) and rests on a bottom surface (33) of the indentation (31), the indentation (31) in the plate (17) being dimensioned such that the piston base (15) fits precisely into the indentation (31), and wherein the bearing face (29) and the bottom surface (33) of the indentation (31) form an essentially plane contact zone and the area of the essentially plane contact zone is larger than or equal to the cross-sectional area of the piston shaft (13).

2. The pump element of claim 1, wherein the bearing face (29) or the face (33) of the indentation that together with the bearing face (29) forms the contact zone has a radius greater than 20× the diameter of the piston shaft (13).

3. The pump element of claim 1, wherein the piston base (15) and the plate (17) are joined together by positive engagement by means of a plate holder (35).

4. The pump element of claim 2, wherein the piston base (15) and the plate (17) are joined together by positive engagement by means of a plate holder (35).

5. The pump element of claim 3, wherein the piston base (15) comprises a collar (43), and wherein the plate holder (35) is joined to the piston (11) via the collar (43).

6. The pump element of claim 3, wherein the piston base (15) comprises a groove (25) with a snap ring (27), and wherein the plate holder (35) is braced on the snap ring (27).

7. The pump element of claim 3, wherein the plate holder (35) is joined to the plate (17) by creative forming, in particular by crimping or folding.

8. The pump element of claim 5, wherein the plate holder (35) is joined to the plate (17) by creative forming, in particular by crimping or folding.

9. The pump element of claim 6, wherein the plate holder (35) is joined to the plate (17) by creative forming, in particular by crimping or folding.

10. The pump element of claim 3, wherein the plate (17), on its circumference on the side toward the piston (11), has a chamfer.

11. The pump element of claim 3, wherein the plate (17) comprises a collar (41), and wherein the plate holder (35) surrounds the collar (41).

12. The pump element of claim 1, wherein the drive element comprises a polygonal ring (19), and wherein the plate (17), comprises a chamfer (40) on its bearing face oriented toward the polygonal ring (19).

13. The pump element of claim 6, comprising a crimped edge (45) embodied on the plate (17), and wherein the crimped edge (45) engages the groove (25) of the piston (11) or surrounds the collar (43) of the piston (11).

14. A piston pump for generating high fuel pressure in fuel injection systems of internal combustion engines, in particular in a common rail injection system, comprising at east one pump element (1), as defined in claim 1.

15. The piston pump of claim 14, wherein the piston pump is embodied as a radial piston pump.

16. The piston pump of claim 14, wherein the piston pump is embodied as a radial piston pump comprising a drive shaft (5) supported in a pump housing (7), which shaft is embodied eccentrically, preferably a plurality of pump elements (1) disposed radially relative to the drive shaft (5), the pistons (11) being movable radially back and forth in the respective cylinder chamber by rotation of the drive shaft (5), and a ring (27) with flat faces (21) disposed between the drive shaft and the plate (17).

17. The piston pump of claim 14, wherein the piston pump is embodied as a distributor pump or inline pump.

18. In a pump element for a piston pump (3) for generating high fuel pressure in fuel injection systems of internal combustion engines, with at least one piston (11), disposed in a cylinder bore (9), the piston (11) having a piston base (15) and a piston shaft (13), and with a plate (17), mounted on the piston base (15), for transmitting the pumping motion from a drive mechanism (5) to the piston (11), the piston base (15) having a bearing face (29) cooperating with an indentation (31) in the plate (17), the improvement wherein the piston base (15) has a diameter larger than the diameter of the piston shaft (13), and the indentation (31) in the plate (17) is dimensioned such that the piston base (15) fits precisely into the indentation (31), and wherein the bearing face (29) and the indentation (31) form an essentially plane contact zone and the area of the essentially plane contact zone is larger than or equal to the cross-sectional area of the piston shaft (13).

19. The pump element of claim 18, wherein the bearing face (29) or the face (33) of the indentation that together with the bearing face (29) forms the contact zone has a radius greater than 20× the diameter of the piston shaft (13).

20. The pump element of claim 18, wherein the piston base (15) and the plate (17) are joined together by positive engagement by means of a plate holder (35).

21. The pump element of claim 19, wherein the piston base (15) and the plate (17) are joined together by positive engagement by means of a plate holder (35).

22. The pump element of claim 20, wherein the piston base (15) comprises a collar (43), and wherein the plate holder (35) is joined to the piston (11) via the collar (43).

23. The pump element of claim 20, wherein the piston base (15) comprises a groove (25) with a snap ring (27), and wherein the plate holder (35) is braced on the snap ring (27).

24. The pump element of claim 20, wherein the plate holder (35) is joined to the plate (17) by creative forming, in particular by crimping or folding.

25. The pump element of claim 22, wherein the plate holder (35) is joined to the plate (17) by creative forming, in particular by crimping or folding.

26. The pump element of claim 23, wherein the plate holder (35) is joined to the plate (17) by creative forming, in particular by crimping or folding.

27. The pump element of claim 20, wherein the plate (17), on its circumference on the side toward the piston (11), has a chamfer.

28. The pump element of claim 20, wherein the plate (17) comprises a collar (41), and wherein the plate holder (35) surrounds the collar (41).

29. The pump element of claim 18, wherein the drive element comprises a polygonal ring (19), and wherein the plate (17), comprises a chamfer (40) on its bearing face oriented toward the polygonal ring (19).

30. The pump element of claim 23, comprising a crimped edge (45) embodied on the plate (17), and wherein the crimped edge (45) engages the groove (25) of the piston (11) or surrounds the collar (43) of the piston (11).

31. A piston pump for generating high fuel pressure in fuel injection systems of internal combustion engines, in particular in a common rail injection system, comprising at least one pump element (1), as defined in claim 18.

32. The piston pump of claim 31, wherein the piston pump is embodied as a radial piston pump.

33. The piston pump of claim 31, wherein the piston pump is embodied as a radial piston pump comprising a drive shaft (5) supported in a pump housing (7), which shaft is embodied eccentrically, preferably a plurality of pump elements (1) disposed radially relative to the drive shaft (5), the pistons (11) being movable radially back and forth in the respective cylinder chamber by rotation of the drive shaft (5), and a ring (27) with flat faces (21) disposed between the drive shaft and the plate (17).

34. The piston pump of claim 31, wherein the piston pump is embodied as a distributor pump or in-line pump.

* * * * *